US008262246B2

(12) United States Patent
Pelletier et al.

(10) Patent No.: US 8,262,246 B2
(45) Date of Patent: Sep. 11, 2012

(54) CLAMPING FLASHLIGHT

(75) Inventors: Thomas Pelletier, Wallingford, CT (US); Karl Vanderbeek, New Haven, CT (US); Brian McNeill, Avon, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 482 days.

(21) Appl. No.: 12/408,406

(22) Filed: Mar. 20, 2009

(65) Prior Publication Data

US 2010/0238653 A1 Sep. 23, 2010

(51) Int. Cl.
*F21L 4/00* (2006.01)

(52) U.S. Cl. ..... 362/191; 362/197; 362/199; 362/396; 362/399

(58) Field of Classification Search ..... 362/190, 362/191, 197, 199, 396, 398, 399, 419, 427, 362/287, 430
See application file for complete search history.

(56) References Cited

U.S. PATENT DOCUMENTS

| | | | | |
|---|---|---|---|---|
| 1,606,219 | A | | 11/1926 | Havens |
| 1,684,347 | A | | 9/1928 | Dobbs |
| 2,034,913 | A | | 3/1936 | Krös |
| 2,165,625 | A | | 7/1939 | Fessel |
| 2,399,511 | A | | 4/1946 | Sabiers |
| 2,448,582 | A | | 9/1948 | Fike |
| 2,561,744 | A | | 7/1951 | Langdon et al. |
| 2,608,639 | A | | 8/1952 | Packer et al. |
| 3,325,639 | A | | 6/1967 | King |
| 3,713,614 | A | | 1/1973 | Taylor |
| 3,992,618 | A | | 11/1976 | Matthews et al. |
| 4,376,965 | A | | 3/1983 | Bacevius |
| 4,399,498 | A | | 8/1983 | Bacevius |
| 4,533,982 | A | | 8/1985 | Kozar |
| 4,895,329 | A | * | 1/1990 | Sloan ..... 248/229.16 |
| 4,907,769 | A | | 3/1990 | Hunley, Jr. et al. |
| 4,936,531 | A | | 6/1990 | Bauser |
| 4,938,440 | A | | 7/1990 | Weinfield |
| 4,980,805 | A | | 12/1990 | Maglica et al. |
| 4,985,817 | A | | 1/1991 | Yale |
| 5,062,026 | A | | 10/1991 | Maglica et al. |
| 5,103,384 | A | | 4/1992 | Drohan |

(Continued)

FOREIGN PATENT DOCUMENTS

DE 4050049-0001 8/2005

(Continued)

OTHER PUBLICATIONS

Search Report as issued for Great Britain Patent Application No. GB0917458.2, dated Jul. 5, 2010.

(Continued)

*Primary Examiner* — Thomas Sember
(74) *Attorney, Agent, or Firm* — Pillsbury Winthrop Shaw Pittman LLP

(57) ABSTRACT

A flashlight includes a lamp head configured to emit light; a lamp head holder including a lower base, an upper base and a first pivot mount supported by the upper base, the upper base being rotatably connected to the lower base such that the upper base and the lower base are rotatable relative to each other about a first axis of rotation, and the lamp head being rotatably connected to the pivot mount such that the lamp head is rotatable relative to the upper base about a second axis of rotation defined by the pivot mount; and a clamp pivotably connected to the lower base of the lamp head holder.

29 Claims, 8 Drawing Sheets

U.S. PATENT DOCUMENTS

| | | | | |
|---|---|---|---|---|
| 5,109,321 | A | 4/1992 | Maglica et al. | |
| 5,144,546 | A | 9/1992 | Burdi | |
| 5,400,234 | A | 3/1995 | Yu | 362/396 |
| 5,420,767 | A | 5/1995 | Jones | |
| 5,448,459 | A | 9/1995 | Rogers | |
| 5,515,246 | A | 5/1996 | Maglica | |
| 5,573,329 | A * | 11/1996 | van Gennep | 362/191 |
| 5,853,241 | A | 12/1998 | Sharrah et al. | |
| 5,860,728 | A | 1/1999 | Maglica | |
| D410,557 | S | 6/1999 | Petterson et al. | |
| 5,993,022 | A | 11/1999 | Neyer et al. | |
| 6,116,747 | A | 9/2000 | Grawemeyer et al. | |
| 6,142,644 | A | 11/2000 | Leung | |
| 6,536,911 | B1 | 3/2003 | DiAngelo | |
| 6,644,827 | B2 | 11/2003 | Birdwell | |
| D496,483 | S | 9/2004 | Christianson | |
| 6,802,623 | B1 | 10/2004 | Hsu et al. | 362/199 |
| 6,817,730 | B2 | 11/2004 | Sharrah et al. | |
| 6,905,223 | B2 | 6/2005 | Halasz | |
| 6,953,260 | B1 | 10/2005 | Allen | |
| 7,011,423 | B2 | 3/2006 | Chen | |
| 7,040,783 | B1 | 5/2006 | Christianson | |
| 7,111,965 | B2 | 9/2006 | Hsu | |
| 7,140,748 | B2 | 11/2006 | Chien | |
| 7,172,310 | B2 | 2/2007 | Hsu | |
| 7,175,318 | B2 | 2/2007 | Booty, Jr. | |
| 7,222,996 | B2 | 5/2007 | Lin | |
| 7,224,271 | B2 | 5/2007 | Wang | |
| 7,226,183 | B2 | 6/2007 | Galli et al. | |
| 7,234,833 | B2 | 6/2007 | Hatherill et al. | |
| 7,290,898 | B2 | 11/2007 | Martin et al. | |
| 7,357,540 | B2 | 4/2008 | Booty, Jr. | |
| 7,850,329 | B2 * | 12/2010 | Henry et al. | 362/191 |
| 8,025,420 | B2 | 9/2011 | Henry et al. | |
| 2002/0034073 | A1 | 3/2002 | Halasz | |
| 2003/0007355 | A1 * | 1/2003 | Leen | 362/287 |
| 2003/0067771 | A1 | 4/2003 | Kung | |
| 2003/0227773 | A1 | 12/2003 | Yang | |
| 2006/0221604 | A1 | 10/2006 | Martin et al. | |
| 2007/0070619 | A1 | 3/2007 | Galli et al. | |
| 2007/0097676 | A1 | 5/2007 | Chien | |
| 2007/0230162 | A1 | 10/2007 | Galli et al. | |
| 2007/0253195 | A1 | 11/2007 | Dietz | |
| 2008/0089058 | A1 | 4/2008 | Galli et al. | |
| 2009/0097263 | A1 | 4/2009 | Ko et al. | 362/372 |
| 2009/0122562 | A1 | 5/2009 | Lee | |
| 2009/0279289 | A1 | 11/2009 | Henry et al. | |
| 2009/0279290 | A1 | 11/2009 | Henry et al. | |
| 2010/0091483 | A1 | 4/2010 | Henry et al. | |
| 2012/0020064 | A1 | 1/2012 | Pelletier et al. | |

FOREIGN PATENT DOCUMENTS

| | | |
|---|---|---|
| JP | 3021409 | 2/1996 |
| JP | 3139156 | 1/2008 |
| WO | WO 2009/137470 A1 | 11/2009 |

OTHER PUBLICATIONS

Search Report as issued for Great Britain Patent Application No. GB0917458.2, dated Feb. 1, 2010.

* cited by examiner

CLAMPING FLASHLIGHT

FIELD

The present invention relates to a clamping flashlight.

BACKGROUND

Battery-powered flashlights are well known in the art and are used in a variety of applications. Typical flashlights include a light source (e.g., LED or an incandescent light bulb), batteries and a switch. The batteries and the switch are arranged in a housing that provides the electrical circuit to activate the light source.

Drawbacks to conventional flashlight designs include design inefficiencies such as engagement of the flashlights with other objects. For example, during operation, the user of a conventional flashlight has to hold the housing and direct the light emitted by the incandescent light bulb with one hand and use the other hand to repair a malfunctioned device illuminated by the flashlight.

SUMMARY

It is desirable to provide a flashlight that can be easily clamped on a mount and can direct light to a desired location so as to free both hands of the user.

In an aspect of the invention, there is provided a flashlight including a lamp head configured to emit light; a lamp head holder including a lower base, an upper base and a first pivot mount supported by the upper base, the upper base being rotatably connected to the lower base such that the upper base and the lower base are rotatable relative to each other about a first axis of rotation, and the lamp head being rotatably connected to the first pivot mount such that the lamp head is rotatable relative to the upper base about a second axis of rotation defined by the first pivot mount; and a clamp pivotably connected to the lower base of the lamp head holder.

In another aspect of the invention, there is provided a flashlight including a lamp head configured to carry a light source capable of emitting light; and a clamp operatively connected to the lamp head and enabling the flashlight to be clamped to a structure, the clamp comprising a pair of clamp portions, at least one of the clamp portions being movable relative to the other to enable the clamp to be configurable between a clamp position and a release position; wherein at least one of the clamp portions includes an elongated structure forming a handle about which the fingers of a user can be wrapped for transporting the flashlight.

In yet another aspect of the invention, there is provided a flashlight including a lamp head configured to emit light; a clamp operatively connected to the lamp to enable the flashlight to be clamped to a structure; and a lamp head holder operatively disposed between the lamp head and the clamp, the lamp head holder enabling pivotal movement of the lamp relative to the clamp about two different perpendicular axes.

These and other objects, features, and characteristics of the present invention, as well as the methods of operation and functions of the related elements of the structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the drawings herein may be considered drawn to scale. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Embodiments of the invention provide a clamping flashlight that includes a lamp head configured to emit light; a lamp head holder including a lower base, an upper base and a first pivot mount supported by the upper base, the upper base being rotatably connected to the lower base such that the upper base and the lower base are rotatable relative to each other about a first axis of rotation, and the lamp head being rotatably connected to the first pivot mount such that the lamp head is rotatable relative to the upper base about a second axis of rotation defined by the first pivot mount, the second axis of rotation being substantially perpendicular to the first axis of rotation; and a clamp pivotably connected to the lower base of the lamp head holder.

Figure 1A:
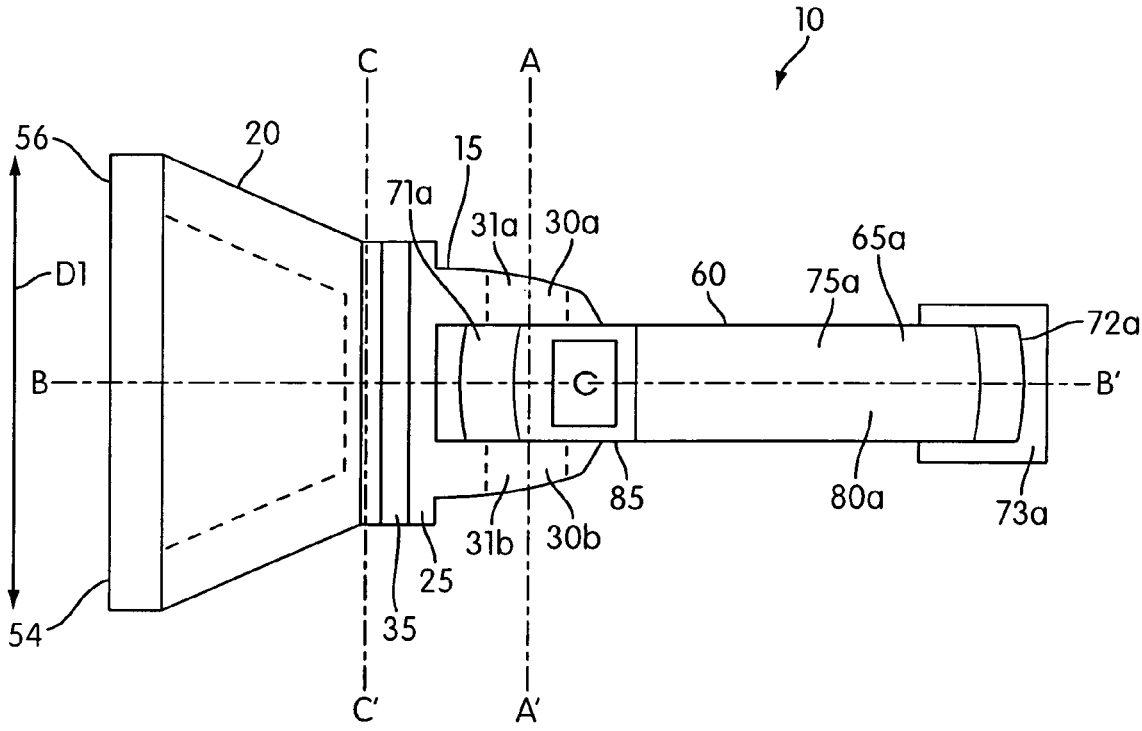
FIG. 1*a* shows a top view of a clamping flashlight in accordance with an embodiment of the invention.
Figure 1B:
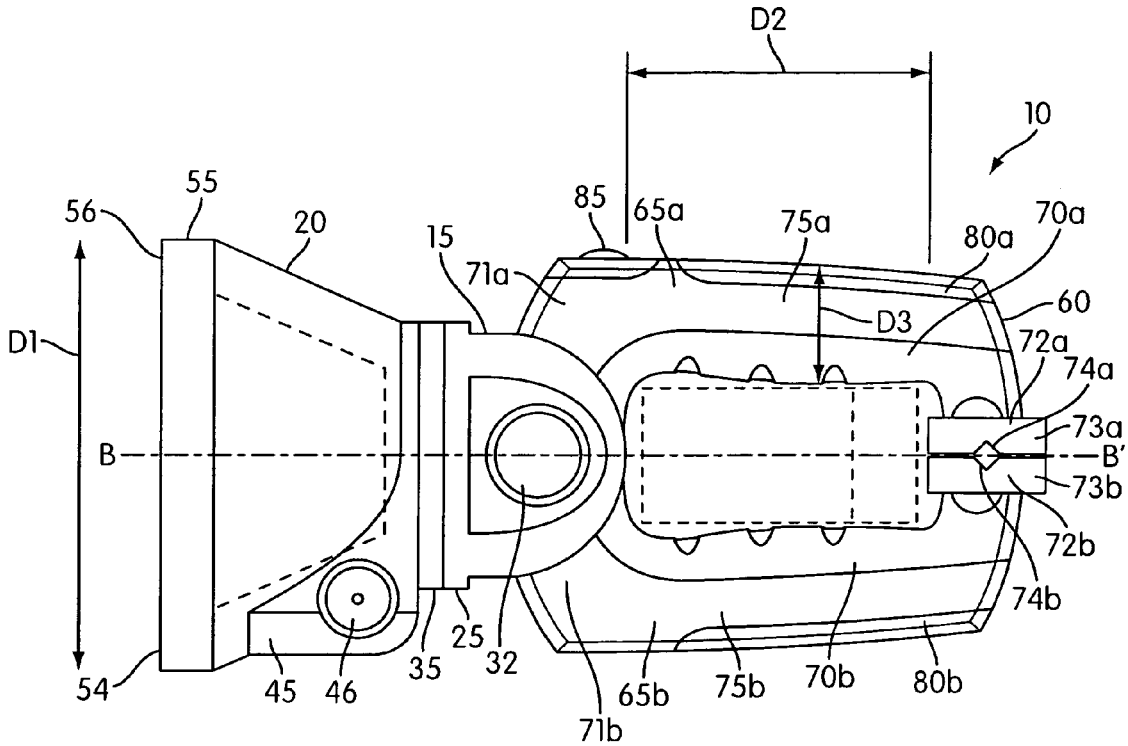
FIG. 1*b* shows a side view of the clamping flashlight shown in FIG. 1*a;*

Referring now to FIGS. 1*a-b*, these figures show, respectively, a top view and a side view of a clamping flashlight 10 in accordance with an embodiment of the invention. The clamping flashlight 10 includes a lamp head holder 15, a lamp head 20 and a mount structure such as a spring biased clamp 60. The lamp head 20 is configured to provide light to a desired location. The lamp head holder 15 is constructed and arranged to be coupled to the lamp head 20 and clamp 60. As will be described hereinafter, the clamp 60 comprises two arms, one or both of which may, in one embodiment, function as a handle.

As shown in FIGS. 1*a-b*, the lamp head holder 15 includes a lower base 25 and an upper base 35. The lower base 25 has two spaced, generally parallel connecting parts 30*a*, 30*b* protruding therefrom that each include a corresponding through-hole 31*a*, 31*b* that receives an axis hinge or axle 32. The axle 32 extends through the clamp 60 to allow the arms 65*a*, 65*b* of the clamp 60 to rotate or pivot about a first pivot axis AA'. The arms 65*a*, 65*b* are pivotable relative to one another, as well as relative to lamp head holder 15, about axis AA'. Similarly, the lamp head holder 15 may be considered to be pivotable relative to clamp 60 about axis AA'. The connecting parts 30*a*, 30*b* and axle 32 together define a pivot mount that is supported by the lower base 25. The upper base 35 and the lower base 25 are constructed and arranged to rotate relative to each other about a second pivot axis BB' over a range of about 360° to direct illumination to a desired location. A bearing surface arrangement is provided between the lower base 25 and upper base 35 and a pivoted connection is provided to permit the relative rotational movement. As will be explained in more detail hereinafter, a detent mechanism may be used to lock the upper base 35 to a desired position after rotation of the upper base 35 relative to lower base 25.

Referring now more particularly to FIG. 1*b*, the upper base 35 supports the pivot mount 45. The pivot mount 45 may be glued to the upper base 35 or attached to it using one or more connectors, such as, for example, one or more screws. Alternatively, the pivot mount 45 may be integral with the upper base 35, in which case the upper base 35 and the pivot mount 45 are constructed as a single piece element, e.g. by molding. The pivot mount 45 is constructed and arranged to pivotably hold the head lamp 20. The pivot mount 45 receives a hinge or axle 46 that extends through a lamp head pivot receiving part 50 (see FIG. 4*b*) of the lamp head 20 to allow the lamp head 20 to rotate or pivot about a third pivot axis CC'. The third pivot axis CC' is shown substantially parallel to the first pivot axis AA' in FIG. 1*a*. However, it will be appreciated that the third pivot axis CC' could also be substantially perpendicular to the first pivot axis AA', e.g. by rotating the upper base 35 90° relative to the lower base 25 about axis BB'. In addition, other intermediate rotational positions between upper base 35 and lower base 25 are such that the axis CC' is neither perpendicular nor parallel to AA'. The pivot mount 45 and the lamp head 20 are constructed and arranged such that the lamp head 20 is able to rotate over a range greater than 90°, as will be described hereinafter and shown in FIGS. 4*a-c*. As shown in FIG. 1*b*, part of the pivot mount 45 may extend beyond the upper base 35 to allow the lamp head 20 to rotate relative to the upper base 35 over a range greater than 90°. As will be explained in more detail hereinafter, a detent mechanism may be used to lock the lamp head 20 at a desired position after rotation of the lamp head 20.

In one embodiment, the housing 55 of the lamp head 20 may have a substantially cone shape. In an embodiment, a diameter D1 of the base 54 (the largest diameter of the head in this embodiment) of the lamp head is in a range of 5 to 6 inches, and in one embodiment is about 5.5 inches. For embodiments with lamp head shapes that incorporate a non-circular shape base, the 5 to 6 inch range can be used for the largest width dimension that can be taken across the base of the head. A light emitting element or light source, such as a bulb or a LED, is provided in the lamp head 20. The light source is electrically connected to a power unit provided in the clamp, as will be explained in more detail hereinafter. In an embodiment, a reflector may be arranged in the housing 55 such that light emitted by the light emitting element is reflected in a desired direction by the reflector. A transparent window 56 is formed at the mouth of the housing 55 to protect the light emitting element and/or to prevent dust or other contaminants from entering the housing 55 and prevent the light from being reflected by the reflector.

The clamp 60 generally includes a first and a second arm, denoted as 65*a* and 65*b*, respectively. Each of the first and second arms 65*a, b* has an elongated shape and is configured to be grasped by a hand of the user. To that effect, arms 65*a*, 65*b* include respective first and second gripping portions 70*a*, 70*b*, which may be made from an elastomeric material (e.g. rubber) to facilitate gripping of the flashlight 10 by the user. In an embodiment, the length D2 of the first and second gripping portions 70*a*, 70*b* is in a range of about 3 to 5 inches, and in one embodiment approximately 4 inches. The diameter (e.g., for generally circular cross sectioned handles) or height (e.g., for non-circular cross sectioned handles) D3 of the first and second gripping portions 70*a*, 70*b* is in a range of at least ½ inch, and in one embodiment between about 1 to 2 inches, and in one embodiment approximately 1.5 inches. The dimensions D2 and D3 are of a measure that provides for an ergonomic gripping region for a typical user. Thus, either arm 65*a* or 65*b* can be comfortably used as the flashlight handle when the flashlight is being manually transported like a conventional flashlight. In one embodiment, only one of the arms 65*a* or 65*b* are dimensioned to be suitably used as a handle. In another embodiment, neither of the arms 65*a* or 65*b* are dimensioned to be used as a handle, and they only perform a clamping function. In yet another embodiment, only one arm 65*a* or 65*b* is pivotable relative to the lamp head holder 15, while the other arm is fixed to or integrally formed with the lamp head holder 15 (e.g. lower base 25 thereof), and in such embodiment the flashlight can still retain a clamping function by movement of the one arm relative to the other.

In one embodiment, the arms 65*a*, 65*b* have a generally U-shape, although it is envisioned that other shapes could be used in other embodiments of the invention. As shown, each arm 65*a*, 65*b* includes, respectively, a first end 71*a, b* and a second end 72*a, b*. First ends 71*a, b* are connected to the pivot mount defined by the two generally parallel connecting parts 30*a*, 30*b* protruding from the lower base 25 of the lamp head holder 20 via the first axle 32. In one embodiment, a clamp mechanism, such as a spring, is arranged in the lamp head holder 20 to bias the arms 65*a, b* and, thereby, the second ends 72*a, b* toward each other.

In one embodiment, a gripping plate 73*a, b* is arranged at the second end 72*a, b* of the arms 65*a,b*. Each gripping plate 73*a, b* includes a plurality of teeth 74*a, b* that are configured to enhance gripping of the plate 73*a, b* to the mounting surface, thereby preventing the plates 73*a, b* and the arms 65*a, b* from sliding on the mounting surface. In one embodiment, the gripping plates 73*a, b* are made of an elastomeric material, although it is envisioned that other types of materials (e.g. steel) could be used on other embodiments. For example, in one configuration, a magnet can be arranged on the gripping plates 73*a, b* to facilitate gripping of the arms 65*a, b* to a mount formed of a metallic material. The magnets could also include a plurality of teeth.

Each arm 65*a-b* includes a casing 75*a-b* that is configured to house a power source, such as a battery assembly including one or more batteries. Each casing 75*a-b* is covered by a respective removable lid 80*a-b* and extends along the respective arm 65*a-b*. Electrical energy is provided to the light emitting element(s) by the battery assemblies via a series of conductive contacts. To that effect, one or more electrical wires extend from the casing 75*a-b* to the housing 55 via the lamp head holder 15 in order to electrically connect, via an on/off switch 85, the battery assembly to the light emitting element(s). It will be appreciated that only one battery assembly (or even one battery) arranged in one of the arms 65*a-b* could be used in an embodiment of the invention.

In one implementation, a plug may be arranged in the clamp 60 to allow the battery assembly to be connected to an external power source. This may be beneficial to recharge the battery assembly.

As shown in FIGS. 1*a-b*, the on/off push button or switch 85 is arranged on the outer surface of the arm 65*a*. The on/off push button is configured to provide a bridge between the battery assembly and the wires that extend from the one or more sockets. Alternatively, in another embodiment, the switch 85 can be a sliding button. Further, in another embodiment, the on/off push button could be arranged on the outer surface of the arm 65*b*.

Figure 2:
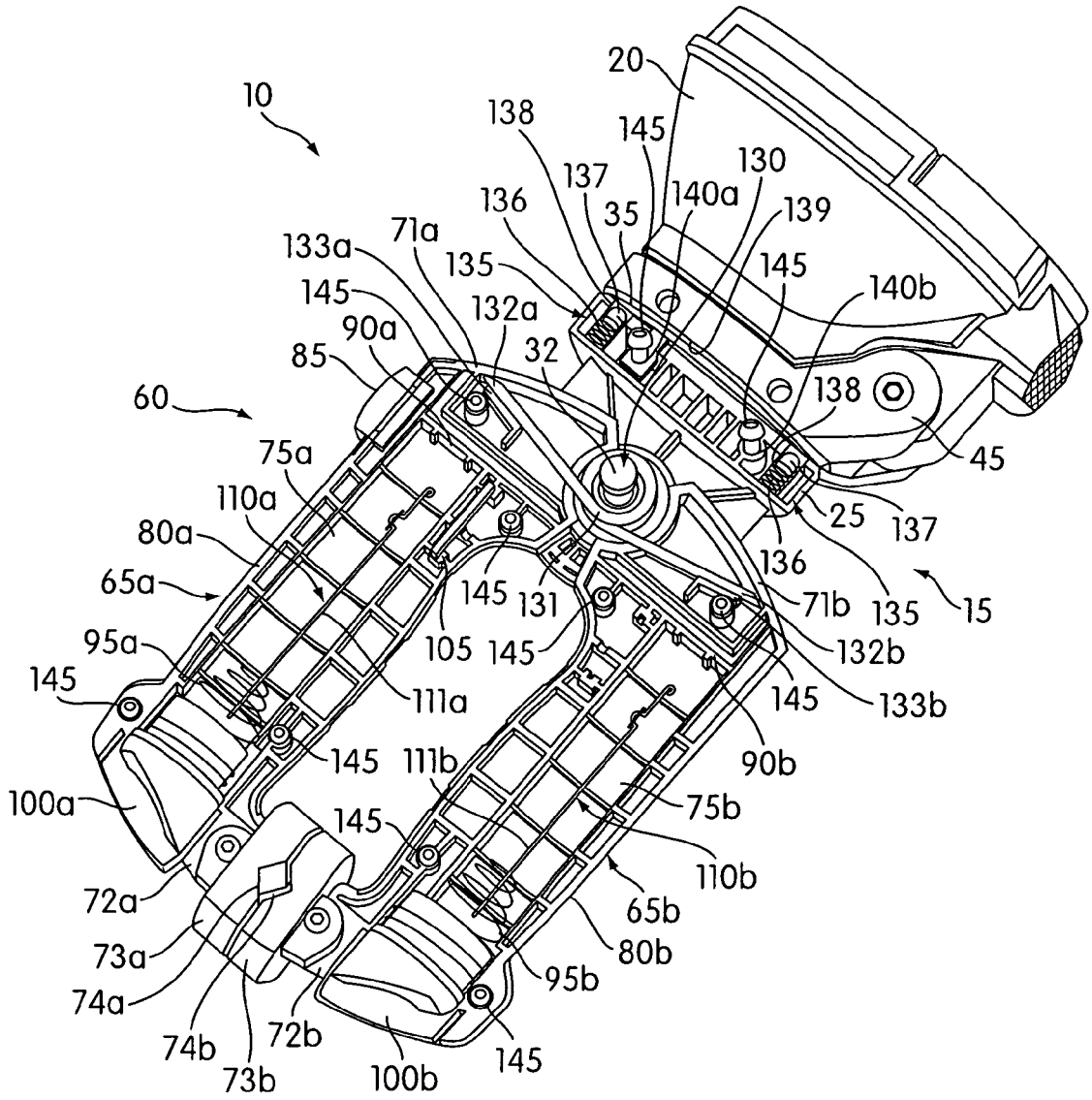
FIG. 2 shows a cross-section of the flashlight in accordance with an embodiment of the invention.

FIG. 2 shows a cross section of the lamp head holder 15 and the clamp 60 in accordance with an embodiment of the invention. Referring more particularly to the clamp 60, each arm 65*a, b* is configured to receive one or more batteries in the first and second casings 75*a, b*. Each arm 65*a, b* includes a plate 90*a, b* that acts as a positive contact for the battery assembly. A metal spring 95*a, b* arranged at the second end 72*a, b* of each arm 65*a, b* acts as a negative contact for the battery assembly. Each metal spring 95*a, b* is attached to a respective cap 100*a, b* that is threadably mounted to its respective arm 65*a, b*. In use, one or more batteries are arranged in the casings 75*a, b* and the caps 100*a, b* are fastened to the arms 65*a, b*. Rotation of the caps 100*a, b* toward the first ends 71*a, b* biases the metal springs 95*a, b* against the battery assembly and provides a continuous electrical contact between the plates 90*a, b* and the respective metal springs 95*a, b*.

Figure 3:
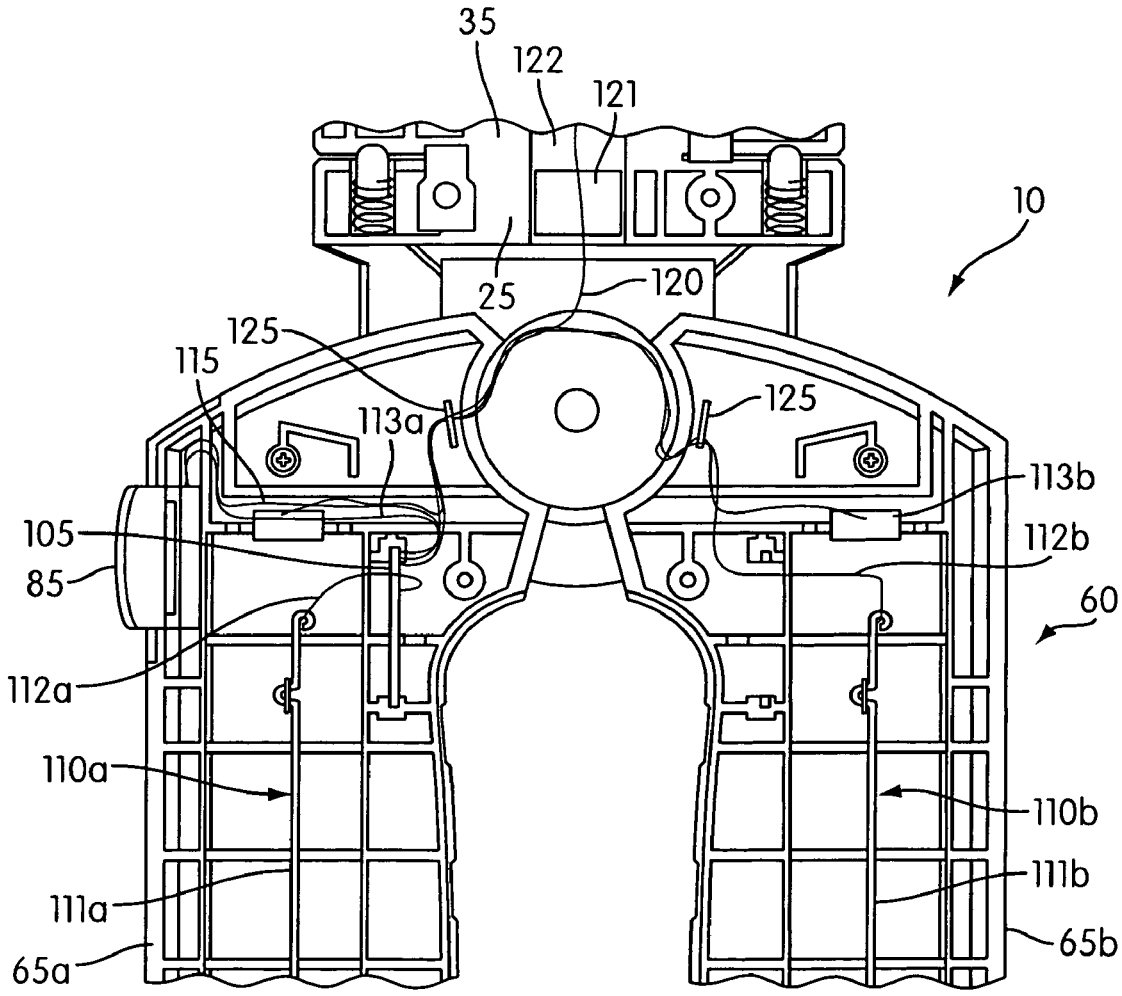
FIG. 3 shows a cross-section of the spring biased handle in accordance with an embodiment of the invention.

Referring now more particularly to FIG. 3, this figure shows a cross-section of the clamp 60 depicting the electrical connections of the flashlight 10. As shown in FIGS. 2 and 3, metal springs 95*a, b* are connected to a driver circuit board 105 via a first set of wires 110*a, b*. The driver circuit board 105 is used to condition the battery assembly voltage to power the light emitting element. Wires 110*a, b* include, respectively, a first wire 111*a, b*, which is attached to a respective arm 65*a, b* and is connected to a respective metal spring 95*a, b*, and a second wire 112*a, b* that is connected to the driver circuit board 105. A second set of wires 113*a, b* connects the respective plate 90*a, b* to the driver circuit board 105. A third wire 115 electrically connects the on/off push button 85 to the driver circuit board 105. Finally, a fourth wire 120 electrically connects the driver circuit board 105 to the light emitting element (not shown in FIGS. 2-3). The fourth wire 120 is passed from the clamp 60 to the lamp head 20 through holes 121, 122 formed in the lower base 25 and upper base 35, respectively. Wires 112*b*, 113*b* and 120 are secured to the spring biased clamp 60 via guides 125 such that these wires remain substantially at a same position when the arms 65*a, b* are rotated.

Referring back to FIG. 2, the clamp mechanism of the clamp 60 includes a leg biasing spring 130 that is attached to the hinge 32. As shown in the embodiment of FIG. 2, the clamp 60 is a spring biased clamp. The spring 130 is configured to act as a biasing mechanism that forces the first and second arms 65*a, b* towards each other. In one embodiment, the leg biasing spring 130 may include a coil part 131 that is wrapped around, and attached to, the hinge 32. The leg biasing spring 130 also includes two legs 132*a, b* that extend from the coil part 131. The leg 132*a* abuts a member 133*a* formed in the second arm 65*b*. The leg 132*b* abuts a member 133*b* formed in the first arm 65*a*. The spring 130 is a torsion spring that biases against both legs 132*a, b*. In use, spreading the arms 65*a, b* apart compresses the coil part 131, which, in turn, creates a reaction spring force that biases the arms 65*a, b* toward each other. In one embodiment, there is no spacing or stop structure between the arms 65*a*, 65*b* when the device is not in use such that the arms contact each other (e.g. via gripping plates as will be described). In another embodiment, the clamp 60 comprises two arms that do not include a spring or spring bias. Instead, a clamp mechanism can be provided that takes the form of a mechanical clamp, such as a ratchet mechanism, or a threaded clamping action between the two arms.

As shown in FIG. 2, two detent mechanisms 135 are arranged in the lower base 25 to lock the rotation of the upper base 35 relative to the lower base 25. In that way, the upper base 35 will remain in the same position after the lamp upper base 35 is rotated to a desired position. The detent mechanisms 135 include springs 136 and balls 137. The springs 136 are arranged in respective recess portions 138 of the lower base 25. The springs 136 are configured to hold the balls 137 into respective cavities or detents 139 formed in the upper base 35. The upper base 35 has a substantially circular shape and includes a plurality of cavities 139 formed at a periphery thereof. During rotation of the upper base 35 relative to the lower base 25, the balls 137 are positioned in the different cavities or detents 139. Once the ball 137 is located in a cavity or detent 139, the upper base 35 remains substantially locked relative to the lower base 25 and the spring 136 is in a substantially uncompressed state. This position is unlocked by applying a rotational force to the upper base 35 that forces the ball 137 out of the cavity or detent 139, which in turn compresses the spring 136. The spring 136 remains in a compressed state until the rotational movement of the upper base 35 presents another cavity or detent 139 at a position where the ball 137 is located. In this manner, the upper base 35 can be locked at a plurality of different positions.

Referring back to FIG. 2, in one embodiment, the clamp 60 may further includes a first plate 140*a* arranged in the upper base 35 and a second plate 140*b* arranged in the lower base 25. The first and second plates 140*a, b* are configured to act as mechanical rotation stops that prevent the rotation of the upper base 35 from exceeding 360°. In this manner, the fourth wire 120 is not damaged during rotation of the upper base 35 relative to the lower base 25.

In another embodiment, rotation of the upper base 35 relative to the lower base 25 can exceed 360°. In this embodiment, a pair of plates is attached to the upper and lower bases 35, 25 respectively. The plates are arranged so as to remain in contact with each other during rotation of the upper base 35 relative to the lower base 25. A first wire connects the light emitting element to the plate arranged in the upper base 35. Similarly, a second wire connects the drive circuit board 105 to the plate arranged in the lower base 25. In this embodiment, electrical contact is provided between the light emitting element and the battery assembly via the wires and the plates regardless of the position of the upper base 35 relative to the lower base 25.

In the embodiment of FIG. 2, the clamp 60 and the lamp head holder 15 are made of molded parts that are assembled together. For example, the alas 65*a, b* and the lower and upper bases 25, 35 can each be made of two parts. A plurality of elongated members 145 are secured in the clamp 60 and the lamp head holder 15 in order to secure the molded parts together.

Figure 4A:
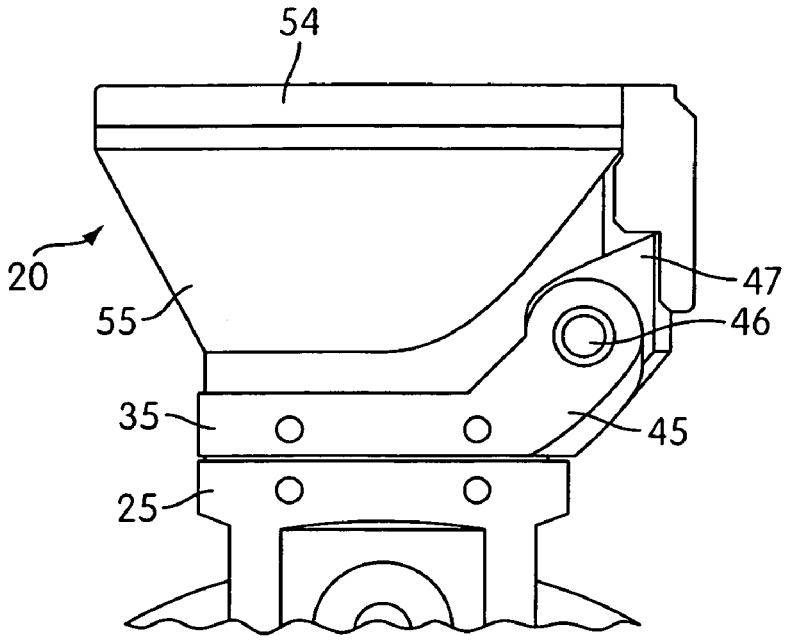
FIGS. 4*a, b* show the lamp head in various positions in accordance with an embodiment of the invention.
Figure 4B:
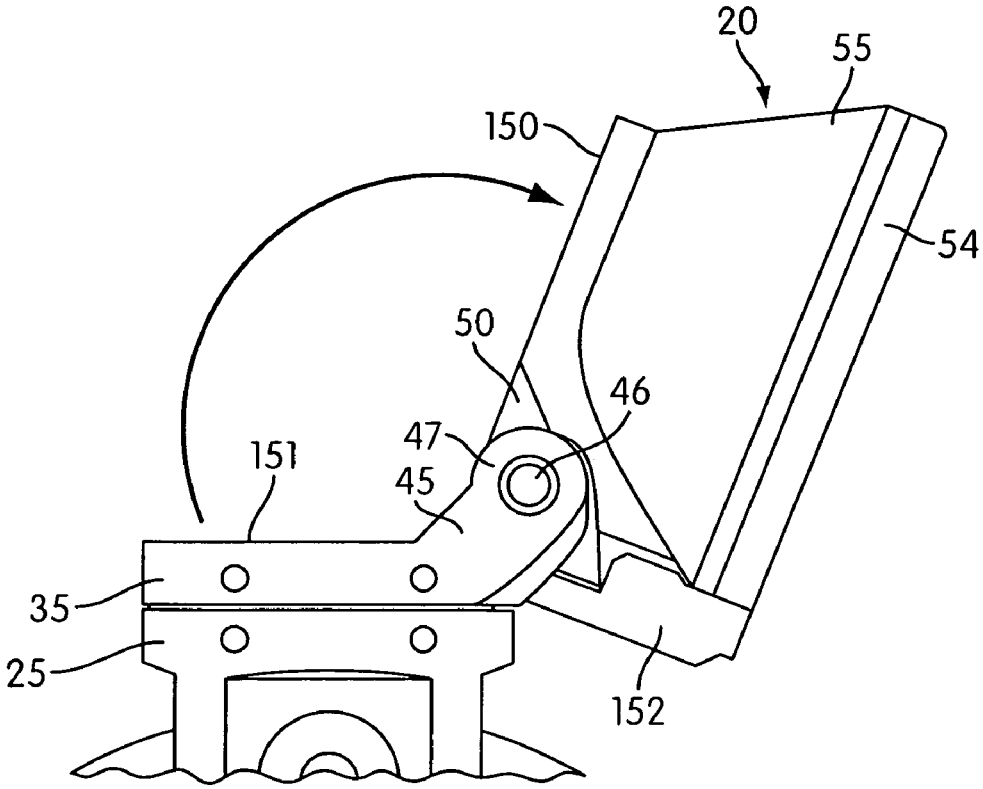
FIG. 4*c* shows an exploded view of the lamp head and the pivot mount in accordance with an embodiment of the invention.
Figure 4C:
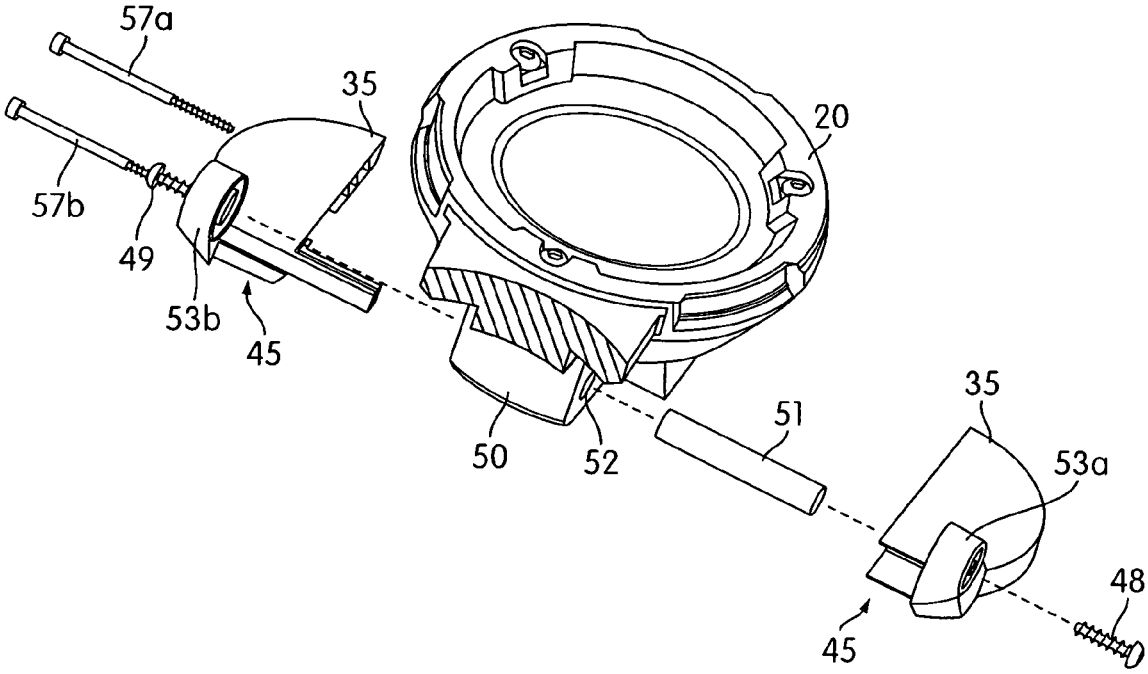

Referring now to FIG. 4*a, b*, these figures show the lamp head 20 in a rest position (FIG. 4*a*) and in an open position (FIG. 4*b*). The lamp head 20 is supported by the pivot mount 45 that is formed on the upper base 35 of the lamp head holder 15. FIG. 4*c* shows an exploded view of the lamp head 20 and the mount 45 in accordance with one embodiment of the invention. The pivot mount 45 includes mount parts 53*a, b* that are located on each side of a pivot mount receiving part 50. The mount parts 53*a, b* are coupled together using screws 57*a, b*, which are received in the upper base 35. The lamp head 20 is coupled to the mount 45 via screws 48, 49 and receiving member 51. Receiving member 51 is arranged in the elongated hole 52 formed in the lamp head 20 such that the lamp head 20 and the receiving member 51 can pivot relative to each other. The lamp head 20 is secured to the mount 45 by securing the screws 48 and 49 to the receiving member 51 arranged in the elongated hole 52 via mount parts 53*a, b*. In another embodiment of the invention, the pivot mount 45 may include a single arm 47.

The degree of rotation of the lamp head 20 relative to the pivot mount 15 is greater than 90°, and in one embodiment greater than 110°. In the embodiment of FIGS. 4*a-b*, the lamp head 20 is configured to rotate between a first position where the bottom 150 of the lamp head 20 is in contact with the top surface 151 of the upper base 35 and a second position where a side portion 152 of the housing 55 abuts the lower base 25. The side portion 152 and the base 54 of the head lamp 20 can include an elastomeric material (e.g. rubber).

Figure 5:
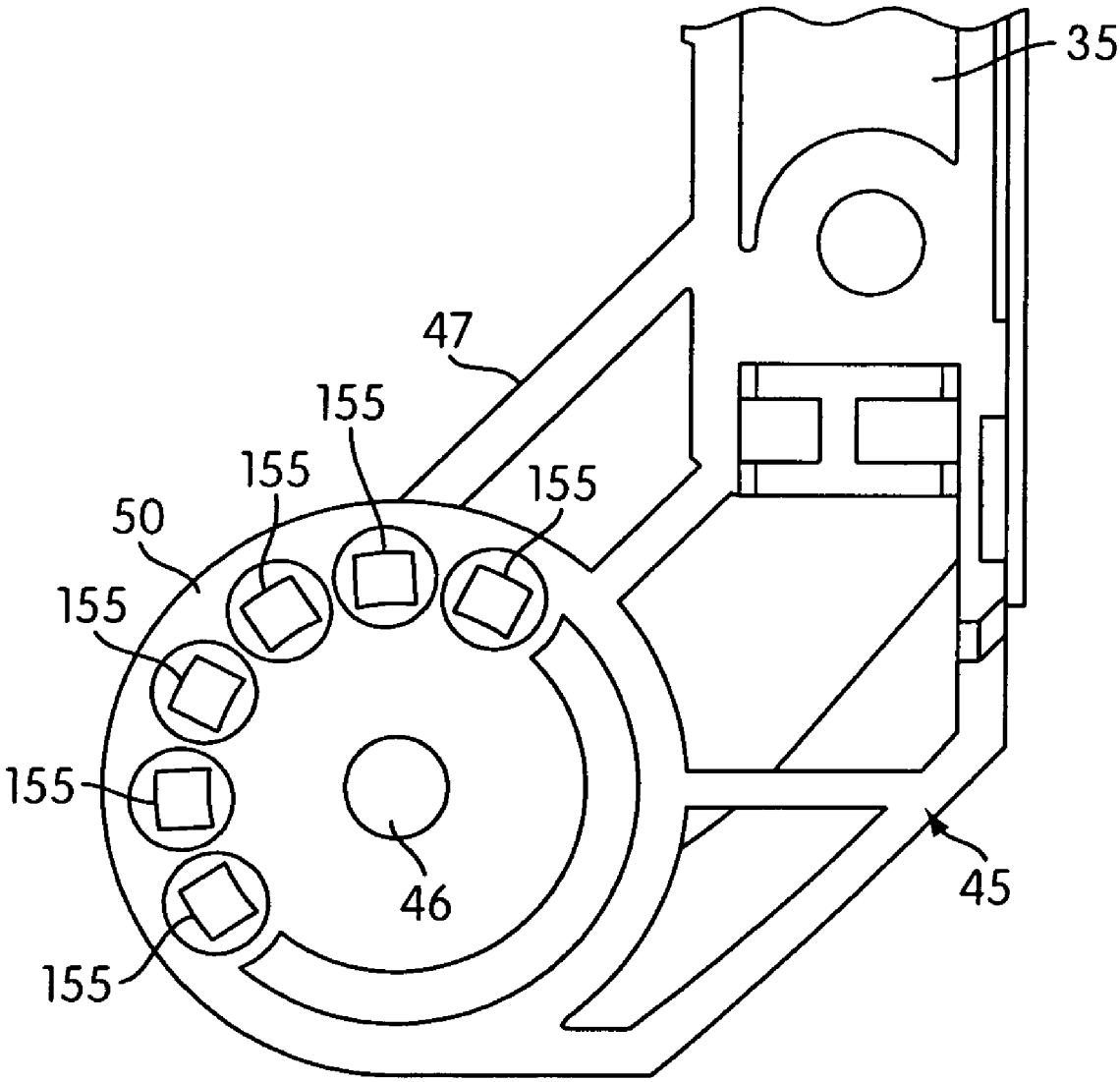
FIG. 5 shows a cross section of the pivot mount of the lamp head holder in accordance with an embodiment of the invention.

A plurality of detent mechanisms can be used to lock the position of the lamp head 20 relative to the pivot mount 45. For example, referring to FIG. 5, this figure shows a cross section of the pivot mount 45 in accordance with an embodiment of the invention. The plurality of detent mechanisms may include a spring (not shown) and a ball (not shown) that are arranged in the pivot mount 45. The pivot receiving part 50 of the lamp head 20 includes a plurality of holes or detents 155 formed at a periphery thereof. The springs of the detent mechanisms are configured to hold the balls in respective holes or detents 55. The principle of operation of the detent mechanism is similar to the one that is used to lock the position of the upper base 35 relative to the lower base 25. Once the ball is located in a hole or detent 155, the pivot receiving part 50 remains substantially locked relative to the pivot mount 45 and the spring is in a substantially uncompressed state. This position is unlocked by applying a rotational force to the pivot receiving part 50 that forces the ball out of the hole or detent 155, which in turn compresses the spring. The spring remains in a compressed state until the rotational movement of the pivot receiving part 50 presents another hole or detent 155 at a position where the ball is located. In this manner, the pivot receiving part 50 can be locked at a plurality of different positions.

Figure 6:
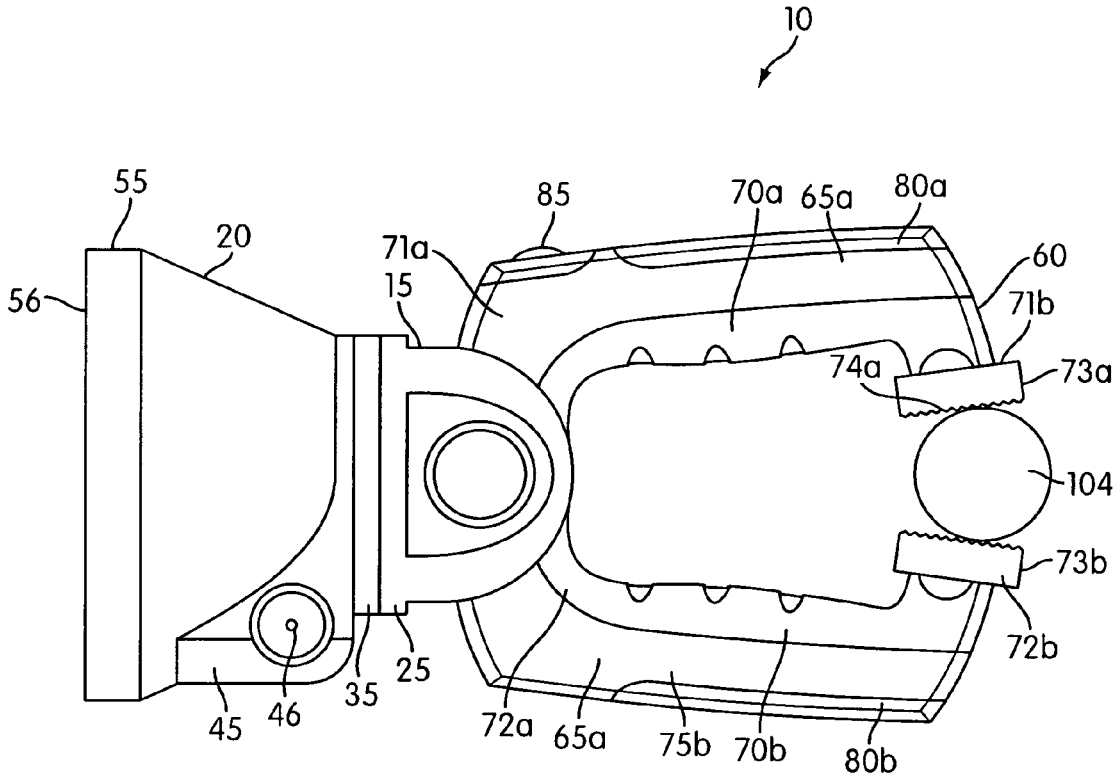
FIG. 6 shows a side view of the clamping flashlight attached to a mount.

In order to operate the flashlight 10, the user first clamps the clamp 60 around a suitable mount 104 near the area to be illuminated, as shown in FIG. 6. The user opens the arms 65*a-b* of the clamp 60 so that the arms 65*a, b* spread apart from each other and rotate about the first pivot axis. The operation can be done with two hands. The user then places the arms 65*a, b* around the suitable mount 104 and releases the arms 65*a, b* so that the biasing mechanism forces the arms 65*a,b* closed and the gripping plates 73*a, b* grip the mounting surface as indicated in FIG. 6. Due to the force of the grip from the biasing mechanism and the friction exerted by the plurality of teeth 74*a, b* of the gripping plates 73*a, b*, the clamp 60 will hold the flashlight 10 securely to the mount 104.

After mounting the flashlight 10 to the mount 104, the user turns on the flashlight 10 by pushing the on/off push button 85 and adjusts the position of the upper base 35 of the lamp head holder 15 relative to the lower base 25 and the position of the lamp head 20 relative to the lamp head holder 15. The position of the upper base 35 relative to the lower base 25 is carried out by rotating the upper base 35 about the second pivot axis 41 in a range between 0° and about less than 360°. The position of the lamp head 20 relative to the lamp head holder 15 is carried out by rotating the lamp head 20 about the third pivot axis in a range between 0° and greater than 90°, for example, about 110°. Due to the detent mechanisms, the lamp head 20 and the upper base 35 will remain in any position to which they are adjusted. If the user decides to illuminate another area, the position of the lamp head 20 can be easily re-adjusted by rotating the lamp head 20 and the upper base 35.

In one embodiment (not illustrated), the clamp 60 may be replaced by another mount structure that is connected to the lamp head holder 15. Such mount structure may take a variety of forms, such as a suction cup, adhesive mounted structure, hook and loop fastened structure, or bolt accommodating mounting structure that allows the flashlight to be mounted on or connected to another object.

It is to be understood that the present invention contemplates that, to the extent possible, one or more features of any embodiment can be combined with one or more features of any other embodiment.

What is claimed is:

1. A flashlight comprising:

a lamp head configured to emit light;

a lamp head holder including a lower base, an upper base and a first pivot mount supported by the upper base, the upper base being rotatably connected to the lower base such that the upper base and the lower base are rotatable relative to each other about a first axis of rotation, and the lamp head being rotatably connected to the first pivot mount such that the lamp head is rotatable relative to the upper base about a second axis of rotation defined by the first pivot mount; and a clamp pivotably connected to the lower base of the lamp head holder, wherein the clamp includes a first arm and a second arm and a clamp mechanism, the clamp mechanism configured to bias at least one of the first and the second arms toward the other and wherein each of the first and second arms includes a grip portion.

2. The flashlight of claim 1, wherein the angle of rotation of the upper base relative to the lower base is in a range lower than about 360°.

3. The flashlight of claim 1, wherein the angle of rotation of the lamp head relative to the upper base is greater than 90°.

4. The flashlight of claim 1, wherein at least one of the arms is rotatable about a third axis of rotation that is substantially perpendicular to the first axis of rotation.

5. The flashlight of claim 4, wherein the lamp head holder includes a second pivot mount supported by the lower base, the second pivot mount configured to hold the at least one clamp arm to allow the at least one clamp arm to rotate about the third axis of rotation.

6. The flashlight of claim 1, further comprising a lock mechanism configured to lock the upper base relative to the lower base at a plurality of selected positions.

7. The flashlight of claim 6, wherein the lock mechanism includes a spring provided in a recess portion of the lower base and a ball, said ball being operatively coupled to the spring and movable to a plurality of cavities formed in the upper base during rotation of the upper base relative to the lower base.

8. The flashlight of claim 7, wherein each of the upper and lower bases includes a rotation stop to prevent the rotation of the upper base relative to the lower base from exceeding 360°.

9. The flashlight of claim 1, further comprising a lock mechanism configured to lock the lamp head relative to the first pivot mount at a plurality of selected positions.

10. The flashlight of claim 9, wherein the lock mechanism includes a spring provided in a recess portion of the first pivot mount and a ball, said ball being operatively coupled to the spring and movable to a plurality of cavities formed in the lamp head during rotation of the lamp head relative to the first pivot mount.

11. The flashlight of claim 1, wherein the clamp includes an handle portion having a length in a range of 3 to 5 inches and a diameter or height of at least ½ inch.

12. The flashlight of claim 1, wherein the second axis of rotation is substantially perpendicular to the first axis of rotation.

13. The flashlight of claim 1, wherein the angle of rotation of the upper base relative to the lower base is greater than 360°.

14. A flashlight comprising:

a lamp head configured to emit light;

a lamp head holder including a lower base, an upper base and a first pivot mount supported by the upper base, the upper base being rotatably connected to the lower base such that the upper base and the lower base are rotatable relative to each other about a first axis of rotation, and the lamp head being rotatably connected to the first pivot mount such that the lamp head is rotatable relative to the upper base about a second axis of rotation defined by the first pivot mount; and a clamp pivotably connected to the lower base of the lamp head holder, wherein the lamp head holder includes a second pivot mount supported by the lower base, and wherein the clamp includes a first arm and a second arm and a clamp mechanism, the clamp mechanism configured to bias the first and the second arms toward each other, at least one of the first and the second arm of the clamp being rotatable about a third axis of rotation that is substantially perpendicular to the first axis of rotation, the second pivot mount configured to hold the at least one of the first and the second arm to allow the at least one of the first and the second arm to rotate about the third axis of rotation.

15. The flashlight of claim 14, wherein each of the first and second arms includes a first end connected to the second pivot mount and a second end including a gripping part, and wherein the gripping part of the first arm and the gripping part of the second arm are biased toward each other.

16. The flashlight of claim 15, wherein the gripping part of each of the first and the second arms includes a magnet.

17. The flashlight of claim 14, wherein each of the first and the second arms has a generally U-shape.

18. The flashlight of claim 14, wherein the first arm and the second arm are biased toward each other so as to define an enclosed opening therebetween that enables the user to hold the flashlight via the first or the second arm.

19. The flashlight of claim 14, wherein the first arm, or the second arm, or both, includes a casing configured to house a battery assembly to power the flashlight.

20. The flashlight of claim 14, wherein the first arm, or the second arm, or both, includes a switch to turn on/off the flashlight.

21. The flashlight of claim 14, wherein the bias comprises a resilient bias and the clamp mechanism includes a spring.

22. A flashlight comprising:

a lamp head configured to emit light;

a clamp to enable the flashlight to be clamped to a structure; and a lamp head holder operatively disposed between the lamp head and the clamp, the lamp head holder enabling pivotal movement of the lamp head relative to the clamp about two different perpendicular axes, wherein the clamp includes a first arm and a second arm that are joined together at a first end of each of the first and the second arm, the first and second arms being movable relative to each other, and wherein the clamp is configured to bias at least one of the first and second arms toward the other one of the first and second arms, and wherein the clamp includes a casing configured to house a battery assembly to power the flashlight.

23. The flashlight of claim 22, wherein the lamp head holder is configured to enable pivotal movement of the lamp relative to the clamp about three different perpendicular axes.

24. The flashlight of claim 22, wherein the first arm and the second arm are spring biased toward each other.

25. The flashlight of claim 22, further comprising a lock mechanism configured to lock the clamp relative to the lamp head at a plurality of selected positions.

26. The flashlight of claim 25, wherein the lock mechanism includes a spring arranged in a lower base of the lamp head holder and a ball, said ball being operatively coupled to the spring and movable to a plurality of cavities formed in an upper base of the lamp head holder during rotation of the upper base relative to the lower base.

27. The flashlight of claim 26, wherein each of the upper and lower bases includes a rotation stop to prevent the rotation of the upper base relative to the lower base from exceeding 360°.

28. The flashlight of claim 26, wherein the angle of rotation of the upper base relative to the lower base is greater than 360°.

29. The flashlight of claim 22, wherein a grip portion enabling a user to hold the flashlight is defined between the first end of at least one of the first and second arms and a second end of the at least one of the first and second arms.

* * * * *